US006624787B2

(12) United States Patent
Puzella et al.

(10) Patent No.: US 6,624,787 B2
(45) Date of Patent: Sep. 23, 2003

(54) SLOT COUPLED, POLARIZED, EGG-CRATE RADIATOR

(75) Inventors: Angelo M. Puzella, Marlboro, MA (US); Fernando Beltran, Mashpee, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/968,685

(22) Filed: Oct. 1, 2001

(65) Prior Publication Data

US 2003/0067410 A1 Apr. 10, 2003

(51) Int. Cl.[7] ..... H01Q 1/38
(52) U.S. Cl. ..... 343/700 MS; 343/778
(58) Field of Search ..... 343/700 MS, 769, 343/778, 767, 770, 787, 725, 853

(56) References Cited

U.S. PATENT DOCUMENTS

| | | | | |
|---|---|---|---|---|
| 3,665,480 A | * | 5/1972 | Fassett | 343/754 |
| 4,527,165 A | | 7/1985 | de Ronde | 343/778 |
| 4,751,513 A | | 6/1988 | Daryoush et al. | 343/700 MS |
| 5,005,019 A | * | 4/1991 | Zaghloul et al. | 343/700 MS |
| 5,055,852 A | * | 10/1991 | Dusseux et al. | 343/725 |
| 5,400,040 A | | 3/1995 | Lane et al. | 343/700 MS |
| 5,451,969 A | | 9/1995 | Toth et al. | 343/781 CA |
| 5,563,613 A | | 10/1996 | Schroeder et al. | 343/700 MS |
| 5,675,345 A | | 10/1997 | Pozgay et al. | 343/700 MS |
| 5,724,048 A | * | 3/1998 | Remondiere | 343/700 MS |
| 5,786,792 A | | 7/1998 | Bellus et al. | 343/770 |
| 6,061,027 A | | 5/2000 | Legay et al. | 343/700 MS |
| 6,087,988 A | | 7/2000 | Pozgay | 343/700 MS |
| 6,104,343 A | | 8/2000 | Brookner et al. | 342/372 |
| 6,127,985 A | | 10/2000 | Guler | 343/771 |
| 6,181,280 B1 | | 1/2001 | Kadambi et al. | 343/700 MS |
| 6,184,832 B1 | | 2/2001 | Geyh et al. | 343/700 MS |
| 6,208,316 B1 | * | 3/2001 | Cahill | 343/909 |
| 6,211,824 B1 | | 4/2001 | Holden et al. | 343/780 MS |
| 6,222,493 B1 | | 4/2001 | Caille et al. | 343/789 |

FOREIGN PATENT DOCUMENTS

| | | |
|---|---|---|
| EP | 0481417 | 4/1992 |
| WO | 9826642 | 6/1998 |
| WO | 9966594 | 12/1999 |
| WO | 0141257 | 6/2001 |

* cited by examiner

*Primary Examiner*—James Clinger
(74) *Attorney, Agent, or Firm*—Daly, Crowley & Mofford, LLP

(57) ABSTRACT

A radiator includes a waveguide having an aperture and a patch antenna disposed in the aperture. In one embodiment, an antenna includes an array of waveguide antenna elements, each element having a cavity, and an array of patch antenna elements including an upper patch element and a lower patch element disposed in the cavity.

36 Claims, 6 Drawing Sheets

SLOT COUPLED, POLARIZED, EGG-CRATE RADIATOR

FIELD OF THE INVENTION

This invention relates generally to radio frequency (RF) antennas, and more particularly to RF array antennas.

BACKGROUND OF THE INVENTION

As is known in the art, a radar or communications system antenna generally includes a feed circuit and at least one conductive member generally referred to as a reflector or radiator. As is also known, an array antenna includes a plurality of antenna elements disposed in an array in a manner wherein the RF signals emanating from each of the plurality of antenna elements combine with constructive interference in a desired direction.

In commercial applications, it is often desirable to integrate RF antenna arrays into the outer surfaces or "skins" of aircraft, cars, boats, commercial and residential structures and into wireless LAN applications inside buildings. It is desirable to use antennas or radiators which have a low profile and a wide bandwidth frequency response for these and other applications.

In radar applications, it is typically desirable to use an antenna having a wide frequency bandwidth. A conventional low profile, wideband radiator has been a stacked-patch antenna which includes two metallic patches, tuned to resonate at slightly different frequencies and supported by dielectric substrates. Thicker substrates (e.g., foams) are preferred in order to increase bandwidth, but there is a trade-off between bandwidth and the amount of power lost to surface waves trapped between the substrates. This trade-off places a restriction on the scan volume and overall efficiency of the phased arrays. Additionally, thick foams increase volume and weight, and absorb moisture which increases signal loss.

Surface waves produced in stacked-patch radiators have undesirable effects. Currents on a patch are induced due to the radiated space waves and surface waves from nearby patches. Scan blindness (meaning loss of signal) can occur at angles in phased arrays where surface waves modify the array impedance such that little or no power is radiated. The array field-of-view is often limited by the angle at which scan blindness occurs due to surface waves.

Waveguide radiators used in "brick" type phased array arrangements (i.e. the feed circuit and electronics for each antenna element is assembled in a plane perpendicular to the antenna radiating surface) do not suffer from internal surface wave excitation with scan angles which limits scan volume, but these waveguide radiators typically do not have a low profile or a wide bandwidth. In addition, individual waveguide radiators must be fabricated and assembled in a brick type architecture thus increasing costs and reducing reliability.

It would, therefore, be desirable to provide a low cost, low profile radiator with a wide bandwidth and a large scan volume which can be used with tile-based or brick-based array arrangements which can be used in land, sea, space or airborne platforms applications.

SUMMARY OF THE INVENTION

It is an object of the present invention to provide a low cost, wide bandwidth, linear or circularly polarized waveguide radiator in a tile array arrangement, meaning all feed networks and active electronics are stacked vertically within the unit cell boundary for each antenna element, without the undesirable surface wave effects normally found in stacked patch antennas.

It is a further object to provide a radiator which can assume arbitrary lattice arrangements such as rectangular, square, equilateral or isosceles triangular, and spiral configurations.

In accordance with the present invention, a radiator includes a waveguide having an aperture and a patch antenna disposed in the aperture and electromagnetically coupled to the waveguide. With such an arrangement, each radiating element and associated feed network are electromagnetically isolated from a neighboring radiating element, thus eliminating internal surface wave excitation and therefore extending the conical scan volume beyond ±70°.

In accordance with another aspect of the present invention, an antenna includes an array of waveguide antenna elements, each element having a cavity, and an array of patch antenna elements including an upper patch element and a lower patch element disposed in said cavity. Such an arrangement provides a low cost, wide bandwidth, linear or circularly polarized waveguide radiator in a tile array arrangement, which in one embodiment includes feed networks and active electronics stacked vertically within the unit cell boundary for each antenna element.

In accordance with another aspect of the present invention, an antenna includes a first dielectric layer having a first plurality of patch antenna elements responsive to radio frequency signals having a first frequency, a first monolithic conductive lattice disposed adjacent to said first dielectric layer, a second dielectric layer comprising a second plurality of patch antenna elements responsive to radio frequency signals having a second different frequency, disposed adjacent to said first monolithic conductive lattice. A second monolithic conductive lattice is disposed adjacent to said second dielectric layer, and the first lattice and said second lattice form a plurality of waveguides, each waveguide associated with each of a corresponding first and second plurality of patch antenna elements. Such an arrangement provides a radiator which can assume arbitrary lattice arrangements such as rectangular, square, equilateral or isosceles triangular, and spiral configurations and a wide bandwidth, low-profile, slot-coupled radiator having the bandwidth of a stacked-patch radiator and the large scan volume of a waveguide radiator.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
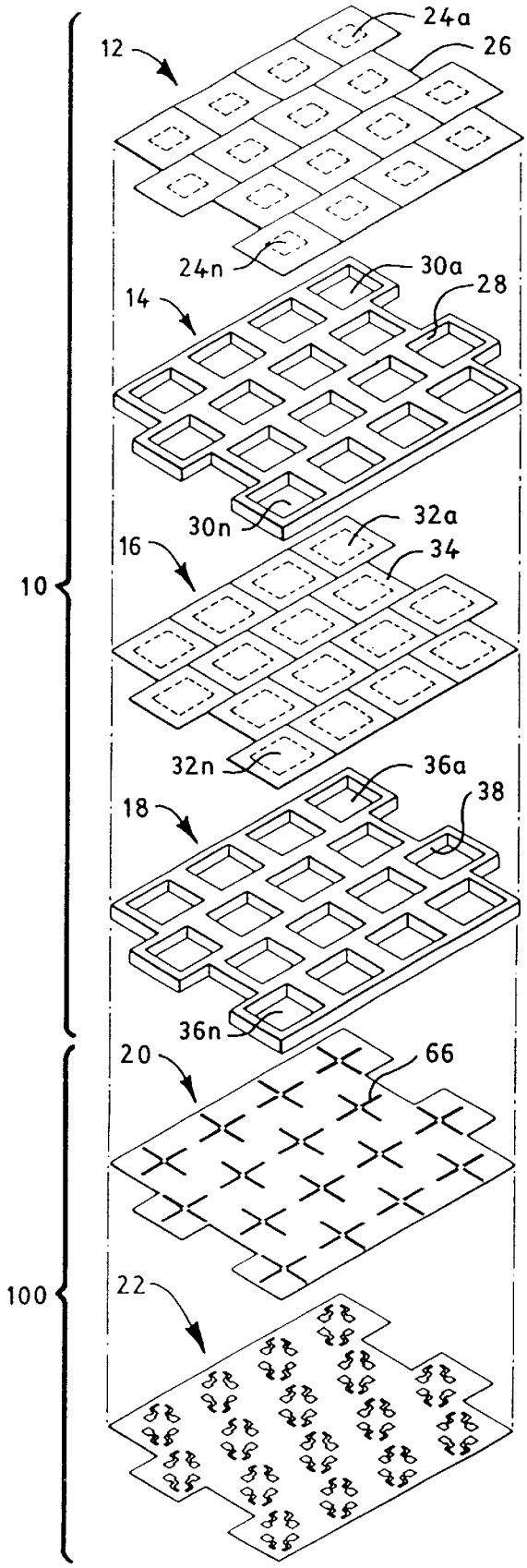
FIG. 1 is a plan view of a stacked-patch egg-crate antenna according to the invention.

Referring now to FIG. 1, a stacked-patch egg-crate antenna 10 and associated feed system 100, here adapted for X-band, is shown to include an upper patch layer 12 disposed on an upper egg-crate layer 14.

The upper patch layer 12 includes a plurality of patches 24*a*–24*n* (generally referred to as upper patch 24) which are arranged on a substrate or patch carrier 26. The dimension of the upper patch 24 is a function of the frequencies used in conjunction with the radiator subsystem 110. In one embodiment used for X-band frequencies the upper patches 24 have a dimension of 0.27λ by 0.27λ where λ is the design wavelength of the antenna 10. It will be appreciated by those of ordinary skill in the art that the patches in the egg-crate radiator could be rectangular, circular or have any number of features to control radiation and mode excitation. Using techniques known in the art, an arbitrary sized and shaped upper patch layer 12 can be fabricated to fit a particular application, polarization requirement (e.g., linear or circular) and mounting surface.

The upper egg-crate layer 14 includes upper sidewalls 28 that define a plurality of upper waveguides 30*a*–30*n* (generally referred to as upper waveguide 30). The dimensions of upper waveguide 30 are determined by the size and spacing of the upper patches 24 and the height $H_{upper}$ of the upper sidewalls 28. In one embodiment, the upper waveguide 30 has an opening of 0.500 inches by 0.500 inches and a height of 0.0950 inches.

A lower patch layer 16, which is disposed adjacent to a lower egg-crate layer 18, is disposed adjacent to the upper egg-crate layer 14. The egg-crate layers 14, 18 form the structural support and the array of waveguide radiators. The lower egg-crate layer 18 is disposed adjacent to the associated feed system 100 which includes a slot layer 20 which is disposed adjacent to a feed circuit layer 22. This arrangement combines the bandwidth of a stacked patch radiator with the isolation of a waveguide radiator in a single laminated structure without the need of physical RF interconnects with the slot layer 20 passing the electromagnetic signals from the feed circuit layer 22 into the antenna 10. Additional layers of the RF circuitry (sometimes referred to as a tile array) below the feed circuit layer are not shown.

The lower patch layer 16 includes a plurality of patches 32*a*–32*n* (generally referred to as lower patch 32 which are arranged on a lower patch carrier 34). The dimension of a lower patch 32 is a function of the frequencies used in conjunction with the antenna 10. In one embodiment used for X-band frequencies, the lower patches 32 have a dimension of 0.35λ by 0.35λ. Using techniques known in the art, an arbitrary sized and shaped lower patch layer 16 can be fabricated to fit a particular application and mounting surface. It should be noted that an adjustment of the height of the upper sidewalls 28 primarily influences the coupling between the upper and lower patches 24 and 32 thereby controlling the upper resonant frequency of the egg-crate radiator passband and the overall bandwidth.

The upper patch layer 12 and the lower patch layer 16 are preferably fabricated from a conventional dielectric material (e.g. Rogers R/T Duroid®) having 0.5 oz. copper layers which are fusion bonded on to each side of the dielectric.

The egg-crate layer 14 and the egg-crate layer 18 are preferably machined from aluminum stock which is relatively strong and lightweight. The egg-crate layers 14, 18 provide additional structure to support the upper patch layer 12, the lower patch layer 16, the slot layer 20, and the feed circuit layer 22. It should be appreciated that the egg-crate layers 14, 18 can also be fabricated by injection molding the basic structure and metalizing the structure with copper or other conductive materials.

The lower egg-crate layer 18 includes lower sidewalls 38 that define a plurality of lower waveguides 36*a*–36*n* (generally referred to as lower waveguide 36). The dimensions of a lower waveguide 36 is determined by the size and spacing of the lower patches 34 and the height $H_{lower}$ of the lower sidewalls 38. Together, the upper and lower waveguides 30 and 36 operate electrically as if they were a single waveguide and eliminate the system limitations imposed by the internal surface waves.

The slot layer 20 which includes slots 66 which electromagnetically couple waveguides 36*a*–36*n* the feed circuit layer 22 to form an asymmetric stripline feed assembly. The asymmetric stripline feed assembly uses a combination of materials and feed circuit arrangement to produce proper excitation and maximum coupling to each slot 66 which passes electromagnetic signals to the antenna layers 12–18. Together, the two assemblies (slot layer 20 and the feed circuit layer 22 and the antenna layers 12–18) produce a thin (preferably 0.169 inches for the X-band embodiment.), light, mechanically simple, low cost antenna. Adjustment of the height of the lower sidewalls 38 primarily influences the coupling between the lower patches 32 and slots 66 thereby controlling a lower resonant frequency of the egg-crate radiator passband and the overall bandwidth.

The feed circuit layer 22 includes a conventional dielectric laminate (e.g., Rogers R/T Duroid®) and is fabricated using standard mass production process techniques such as drilling, copper plating, etching and lamination.

As the thickness of a conventional antenna with dielectric or foam substrates increases to enhance bandwidth, the angle at which the lowest order surface wave can propagate decreases thereby reducing efficient antenna performance over a typical phased array scan volume. However, the low profile, waveguide architecture of the stacked-patch egg-crate antenna 10 eliminates surface waves that are trapped between elements enabling increased bandwidth and scan volume performance (greater than ±70°) which are critical parameters for multi-function phased arrays.

Each cavity formed by the stacked, metallic upper egg-crate layer 14 and lower egg-crate layer 18 physically isolates each antenna element from all other antenna elements. The metallic sidewalls 28 and 38 of the cavity present an electrically reflecting boundary condition. In either transmit or receive mode operation, the electromagnetic fields inside a given stacked-patch egg-crate cavity are isolated from all other stacked-patch egg-crate cavities in the entire phased array antenna structure. Thus, internally excited surface waves are substantially reduced independent of cavity height, lattice geometry, scan-volume, polarization or bandwidth requirements.

The relatively thin, upper patch carrier 26 also serves as an integrated radome for the antenna 10 with the upper and lower egg-crate layers 14, 18 providing the structural support. This eliminates the need for a thick or shaped radome to be added to the egg-crate radiator and reduces the power requirements for an anti-icing function described below.

Figure 2:
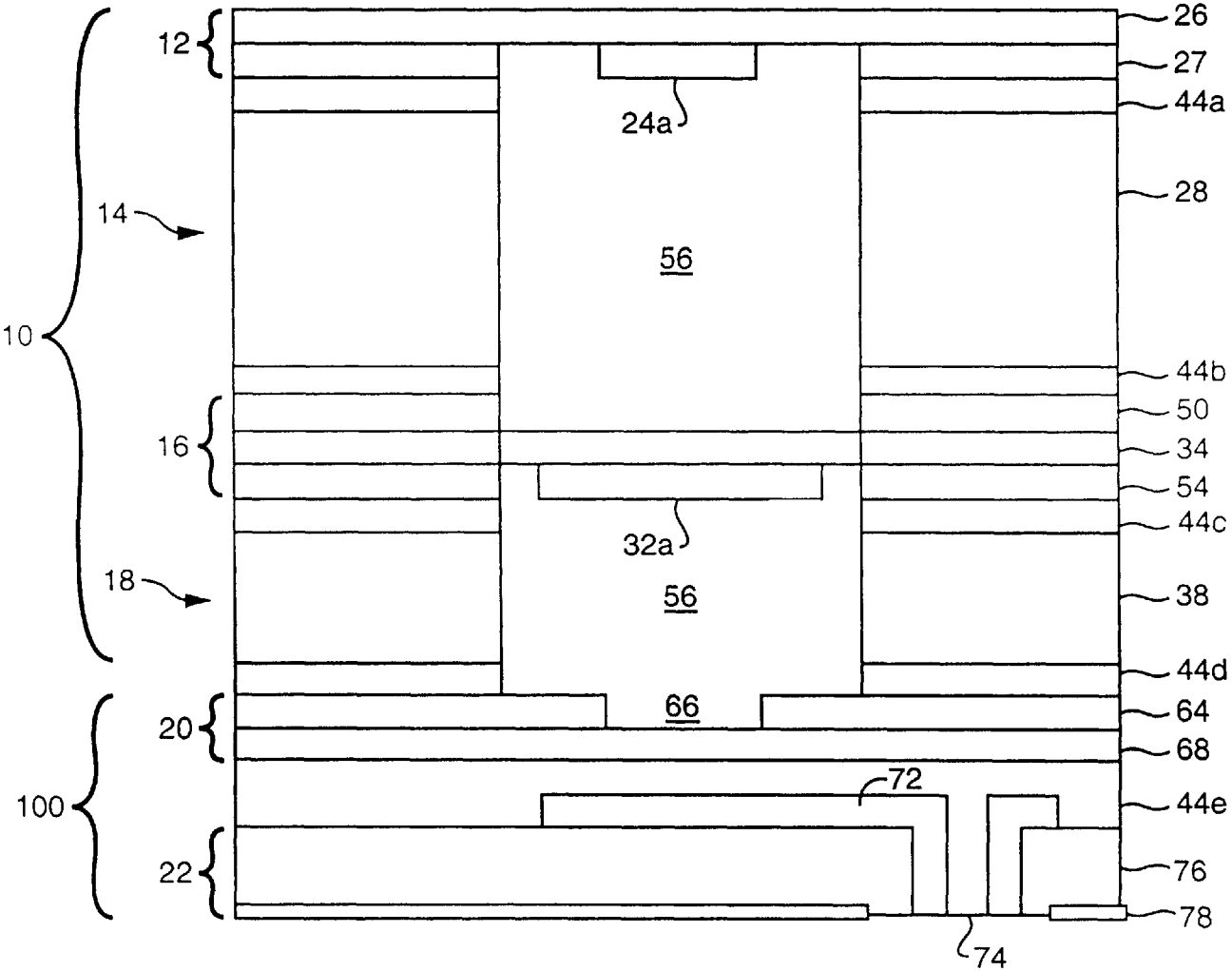
FIG. 2 is a cross sectional view of a stacked-patch egg-crate antenna.

Referring now to FIG. 2, further details of the structure of the antenna 10 and feed subsystem 100 are shown with like reference numbers referring to like elements in FIG. 1. The upper patch layer 12 includes a copper layer 27 disposed on a lower surface of the upper patch carrier 26. The upper patch layer 12 is attached to the upper surface of sidewalls 28 of the upper egg-crate layer 14 by attachment layer 44*a*.

The lower patch layer 16 includes a copper layer 50 disposed on the upper surface of the lower patch carrier 34 and a bottom copper layer 54 disposed on the bottom surface of the lower patch carrier 34. The lower patch layer 16 is attached to the lower surface of sidewalls 28 of the upper egg-crate layer 14 by attachment layer 44*b*. The lower patch layer 16 is attached to the upper surface of sidewalls 38 of the lower egg-crate layer 18 by attachment layer 44*c*.

The attachment layers 44*a*–44*d* preferably use Ni—Au or Ni-Solder plating. The Ni—Au or Ni-Solder plating is applied to the lower and upper egg-crates layers 14 and 18 and the etched copper egg-crate pattern on the lower and upper patch layers 12 and 16 using standard plating techniques. The entire egg-crate radiator structure is then formed by stacking layers 12–18 and re-flowing the solder. Alternatively layers 12–18 can be laminated together using conductive adhesive pre-forms as is known in the art.

A waveguide cavity 56 is formed by the upper and lower egg-crate layers 14, 18, which includes patches 24*a* and 32*a*. The metallic sidewalls 28, 38 of the cavity formed by the upper egg-crate layer 14 and the lower egg-crate layer 18 present an electrically reflecting boundary condition to the electromagnetic fields inside the cavity, equivalent to a wave-guiding structure. The electromagnetic fields are thus internally constrained in each waveguide cavity 56 and isolated from the other waveguide cavities 56 of the structure. Preferably the cavity for each egg-crate is 0.5 inch×0.5 inch for an X-band system.

The feed subsystem 100 includes slot layer 20 and feed circuit layer 22. Slot layer 20 includes metal layer 64 and support layer 68. Metal layer 64 includes slots 66 which are apertures formed by conventional etching techniques. Metal layer 64 is preferably copper. Feed circuit layer 22 includes stripline transmission line layer 72 and a lower copper ground plane layer 78, with carrier layer 76 and via's 74 connecting the upper copper layer 72 with stripline transmission line layers (not shown) below the lower copper ground plane layer 78. Slot layer 20 and feed circuit layer 22 are joined with attachment layer 44*e*. The feed subsystem 100 is assembled separately and subsequently laminated to antenna 10 with attachment layer 44*d*. As described above attachment layer 44*d* uses either a low temperature solder or a low temperature electrically conductive adhesive techniques to join the respective layers. Layers 72 and 78 are preferably copper-fused to carrier layer 76 which is a conventional dielectric material (e.g. Rogers R/T Duroid®).

The aluminum egg-crate layers 14 and 18 form the waveguide radiator cavity 56 and provide the structural support for the antenna. When assembled with the feed subsystem, the two aluminum egg-crates layers 14 and 18 and carrier layers 26 and 34 form the antenna 10. This assembly can be bonded to a tile array stack-up (described below in conjunction with FIG. 4) using a low temperature solder or, equivalently, a low temperature electrically conductive adhesive layer. Alternatively, the egg-crate ribs allow the antenna 10 and feed subsystem 100 to be mechanically fastened with screws or other types of fasteners (not shown) to the tile array cold plate (described below in conjunction with FIG. 4). This alternative embodiment allows serviceability by disassembly of the antenna from the tile array to replace active components. This service technique is not practical for conventional foam based radiators.

Table 1 summarizes the radiator material composition, thickness and weight for an embodiment constructed as a prototype for an X-band system.

TABLE 1

RADIATING ELEMENT STACK-UP

| Component | Material | Thickness (in.) | Weight (oz.) |
|---|---|---|---|
| Upper Patch layer 26 | Rogers 3006 | 0.0100 | 0.00603 |
| Attachment Layer 44a | Ni-Cu-Sn(60%)/ Pb(40%) | 0.0009 | 0.00043 |
| Upper Egg-crate 14 | Aluminum | 0.0950 | 0.03364 |
| Attachment Layer 44b | Ni-Cu-Sn(60%)/ Pb(40%) | 0.0009 | 0.00043 |
| Lower Patch Layer 34 | Rogers 3010 | 0.0005 | 0.00348 |
| Attachment Layer 44c | Ni-Cu-Sn(60%)/ Pb(40%) | 0.0009 | 0.00043 |
| Lower Egg-crate 18 | Aluminum | 0.0250 | 0.00610 |
| | | Total: 0.138 | Total: 0.0505 |

It should be noted that the stacked patch egg-crate antenna 10 including layers 12, 44*a*, 14, 44*b*, 16, 44*c*, and 18 has no bonding adhesives in the RF path which includes the waveguide 56, upper and lower patches 24 and 32, and corresponding support layer. The absence of bonding adhesives in the RF path helps to reduce critical front-end loss. Front-end ohmic loss directly impacts radar or communication performance by increasing the effective antenna temperature, thus reducing antenna sensitivity and, ultimately, increasing antenna costs. In a conventional foam based stacked-patch radiator, mechanically reliable bonding adhesives introduce significant ohmic loss at microwave frequencies and above. Reliability is an issue as thickness of adhesives and controlling foam penetration becomes another difficult to control parameter in production. Furthermore, it is difficult to copper plate and etch foam structures in large sheets, and typically the foam sheets require a protective coating against the environment.

Returning to FIG. 2, in operation an RF signal is coupled from active layers (not shown) through via 74 to the feed circuit layer 22. Preferably the stripline transmission line layer 72 is located closer to the slots 66 in slot layer 20 (e.g. 7 mils) than the ground plane layer 78 (25 mils) providing an asymmetric, stripline feed circuit in order to enhance coupling to the slots 66. The asymmetric, stripline feed circuit layer 22 guides a radio-frequency (RF) signal between the via 74 and the stripline transmission line layer 72. The RF signal is coupled from the stripline transmission line to the non-resonant slot 66. The lower and upper metallic egg-crate layers 18 and 14 form an electrically cut-off (non-propagating fundamental mode) waveguide 56 for each unit cell. The lower patch 32 and upper patch 24 inside the waveguide 56 resonate the slot, waveguide cavity, and radiating aperture at two distinct frequencies providing wide band RF radiation into free space.

Figure 5A:
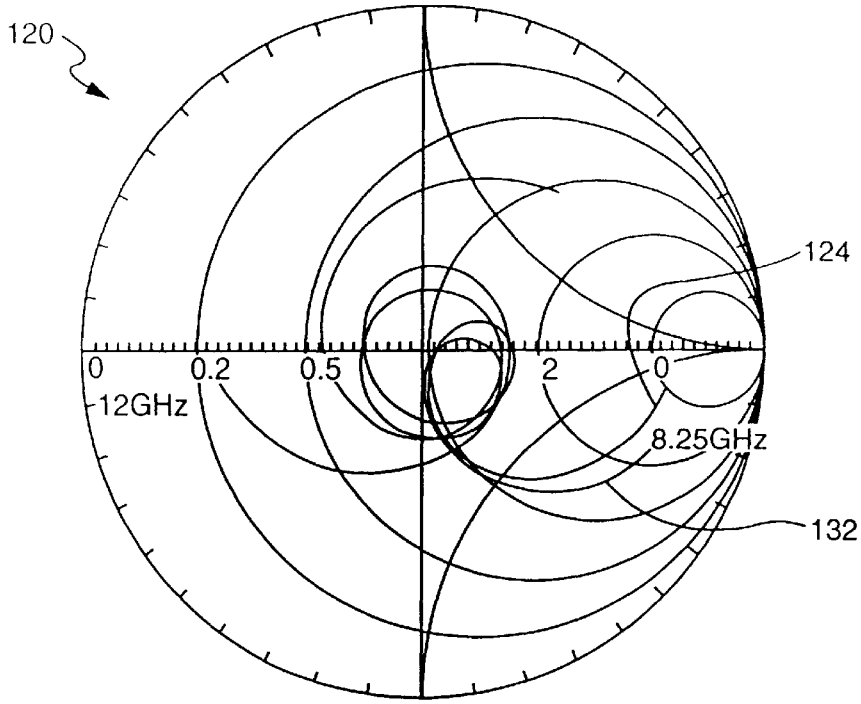
FIG. 5A is a Smith chart of the normal and de-embedded impedance loci of the stacked-patch egg-crate antenna in one embodiment according to the invention.

When viewed as a transmission line, each patch 24, 32 presents an equivalent shunt impedance having a magnitude of which is controlled by the patch dimensions and dielectric constant of the patch carriers 26, 34. The shunt impedance and relative separation of the patches (with respect to the non-resonant slot) are adjusted to resonate the equivalent series impedance presented by the non-resonant slot, waveguide cavity and radiating aperture, thus matching to the equivalent impedance of free space. The transmission line stubs 83*a*–83*d* (FIG. 3) present a shunt impedance to the circuit which is adjusted to center the impedance locus on the Smith Chart (FIG. 5A).

The fringing electromagnetic fields of the slot, upper and lower patches 24, 32 are tightly coupled and interact to provide the egg-crate antenna 10 with an impedance characteristic represented by curves 124, 132, (FIG. 5A) centered on the X-Band Smith Chart indicating the normal and de-embedded impedance loci respectively. As noted, the relative size and spacing between the patches 24, 32 and slot 66 are adjusted to optimize coupling and, therefore, maximize bandwidth. The coupling between the non-resonant slot 66 and lower patch 32 primarily determines the lower resonant frequency, and the coupling between the upper patches 24 and lower patches 32 primarily determines the upper resonant frequency.

Figure 3:
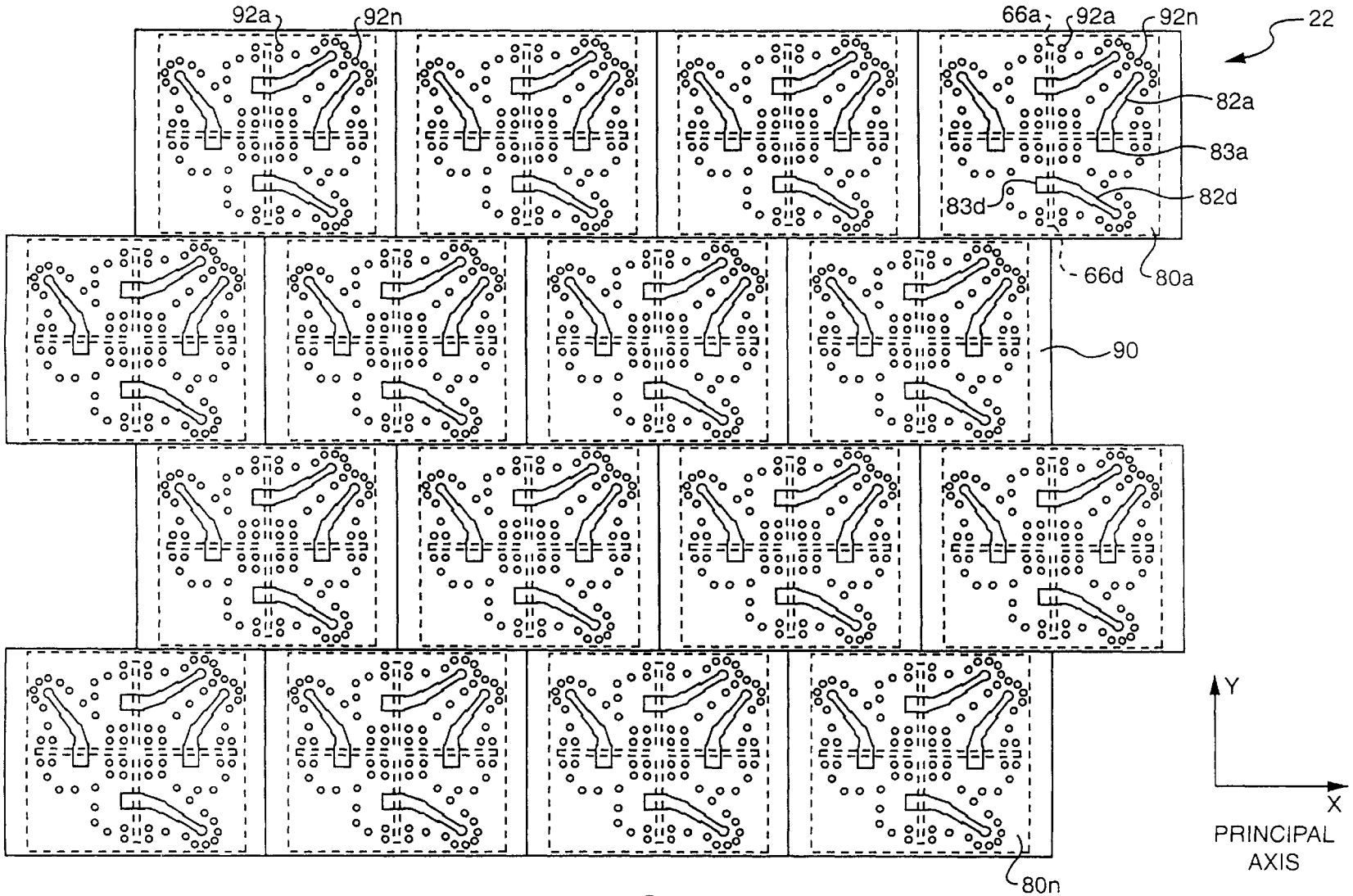
FIG. 3 is a bottom view of an exemplary slot layer and feed circuit.

Referring to FIG. 3, the slots 66 of the slot layer 20 (FIG. 1) are shown superimposed over the feed circuit layer 22 (FIG. 1). The feed circuit layer 22 includes a plurality of balanced-feed unit cells 80*a*–80*n* (generally referred to as balanced-feed unit cell 80). Each of the plurality of balanced-feed unit cells 80 includes four isolated, asymmetric (i.e., the stripline is not symmetrically located between the ground planes) stripline feeds 82*a*–82*d* (generally referred to as stripline feed 82), each feeding a non-resonant slot 66*a*–66*d* respectively which is located above the stripline feeds 82*a*–82*d*. Stripline feeds 82*a*–82*d* include a corresponding transmission line stubs 83*a*–83*d*. The slots 66*a*–66*d* are located in the separate slot layer 20 (FIG. 1). Mode suppression posts 92*a*–92*n* are disposed adjacent to each stripline feeds 82*a*–82*d* in a balanced-feed unit cell 80. The mode suppression posts are preferably 0.0156" (standard drill size) diameter plated-through-holes. The 4×4 array of FIG. 3 depicts the balanced feed arrangement, but it should be appreciated that an arbitrary sized array, lattice spacing, arbitrary lattice geometry (i.e., triangular, square, rectangular, circular, etc.) and arbitrary slot 66 geometry and configuration can be used (e.g., single, full length slot or two orthogonal slots).

The mode suppression posts 92*a*–92*n* isolate each of the stripline feeds 82*a*–82*d* in a balanced-feed unit cell 80, and each balanced-feed unit cell 80 is isolated from the other balanced-feed unit cells 80. Depending on the arrangement of the stripline feeds 82*a*–82*d*, a linear, dual linear, or circular polarization mode of operation can be achieved. The balanced feed configuration presented in FIG. 3 can be operated in a dual-linear or circularly polarized system. Coupling is enhanced by the thin, high dielectric constant polytetrafluorethylene (PTFE) layer 68 of slot layer 20 and adjustment of the length and width of transmission line stubs 83*a*–83*d* that extend beyond the non-resonant slot.

In one embodiment a feed layer includes the feed circuit layer 22 from layer 78 up to the ground plane layer 64 of the slot layer 20 (FIG. 2). The feed circuit layer 22 includes stripline feeds 82 (FIG. 3) to provide an impedance transformation from the via 74 (nominally 25 ohms) to the slot 66 and egg-crate radiator 10 (nominally 10 ohms). This compact stripline feed configuration uses two short-section transformers (i.e. the length of each section is less than a quarter wavelength) that matches the input impedance of the via to the slot and egg-crate radiator impedance over a wide bandwidth. The length and impedance of each transformer section is chosen to minimize reflections between the via and the slot. A wider section (35-mils) of the stripline feed, the transmission line stub 83*a* extends beyond the center of the slot with respect to the narrower sections (30-mils, 21-mils, 15-mils) of the stripline feed 82. The transmission line stub 83*a* provides a shunt impedance to the overall circuit including via 74, stripline feed 82, slot 66, and egg-crate layers 14, 18, and its length and width are adjusted to center the impedance locus on the Smith Chart and minimize the magnitude of the reactive impedance component of the circuit.

The pair of co-linear slots 66*a*–66*d* (FIG. 3) are provided to reduce cross-coupling at the intersection between the orthogonal pair of co-linear slots and to allow more flexibility in the feed circuit design. The upper PTFE layer 68 (here 5-mils thick) and lower PTFE layer 76 (here 25-mils thick) of the feed assembly preferably have a dielectric constant of approximately 10.2 and 4.5, respectively, which enhances coupling to the slot layer 20. In addition, the choice of dielectrics 68 and 76 allows a balanced feed configuration preferably including four slots to fit in a relatively small unit cell at X-Band (0.52 in. base×0.60 in. alt.) and permits reasonably sized transmission line sections that minimize ohmic loss and comply with standard etch tolerance requirements.

The slots 66*a*–66*d* (FIG. 3) are non-resonant because they are less than 0.5 (where represents the dielectric-loaded wavelength) in length over the pass band. The choice of non-resonant slot coupling provides two benefits in the present invention. First, the feed network is isolated from the radiating element by a ground plane 90 that prevents spurious radiation. Second, a non-resonant slot 66 eliminates strong back-lobe radiation (characteristic of a resonant slot) which can substantially reduce the gain of the radiator. Each stripline feed 82 and associated slot 66 is isolated by 0.0156" diameter plated through-holes. Table 2 summarizes the asymmetric feed layer material composition, thickness and weight.

TABLE 2

FEED LAYER STACK-UP

| Component | Material | Thickness (in.) | Weight (oz.) |
|---|---|---|---|
| Upper Board 68 | Rodgers RO3010; $\epsilon$ = 10.2, tan$\delta$ = .003 | 0.005 | 0.00348 |
| Adhesive 44e | FEP; $\epsilon$ = 2.0, tan$\delta$ = .0005 | 0.001 | 0.0010 |
| Lower Board 76 | Rodgers TMM4; $\epsilon$ = 4.5, tan$\delta$ = .002 | 0.025 | 0.0114 |
| | | Total: 0.031 | Total: 0.0159 |

Tan$\delta$ is the dielectric loss tangent and $\in$ is the dielectric constant.

The balanced, slot feed network is able to fit in a small unit cell area: 0.52" (alt.)×0.60" (base). The height is thin (0.031") and lightweight (0.0159 oz.). Coupling is enhanced between the stripline feed 82 and slot layer 20 by placing a thin (5-mil), high dielectric constant (10.2) PTFE sheet layer 68, which concentrates the electric field in that region between the two layers 82 and 20.

Preferably, standard etching tolerances (±0.5 mils for 0.5 oz. copper) and a low plated through-hole aspect ratio (2:1) are used. Wider line widths reduce ohmic losses and sensitivity to etching tolerances.

Alternatively the radiator design of the present invention can be used with a low temperature, co-fired ceramic (LTCC) multilayer feed. Slot coupling permits the egg-crate radiator to be fabricated from materials and techniques that differ from materials and construction of the slot layer 20 and feed circuit layer 22.

Figure 4:
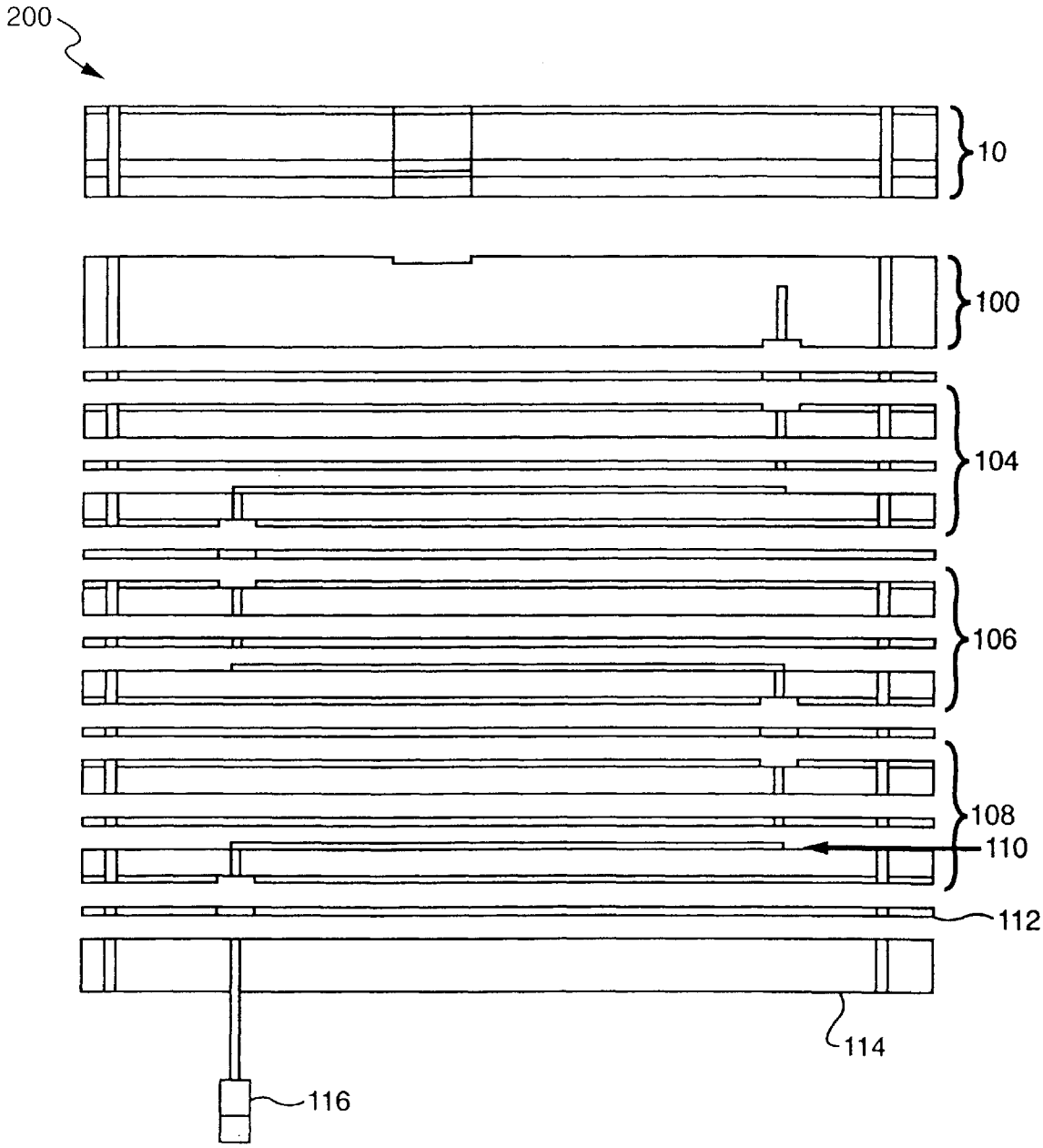
FIG. 4 is a cross sectional view of a radiating element included in a stacked-patch egg-crate antenna and associated feed system.

Referring to FIG. 4, an X-Band tile-based array 200 includes an egg-crate antenna 10, an associated feed subsystem 100, a first Wilkinson divider layer 104, a second Wilkinson divider layer 106, a transformer layer 108, a signal trace layer 110, a conductive adhesive layer 112, and a conductor plate 114 stacked together. Layers 104–106 are generally referred to as the signal divider/combiner layers. The X-band tile based array 200 further includes a coaxial connector 116 electrically coupled the connector plate.

The antenna 10 and feed subsystem 100 can be mechanically attached by fasteners to the active modules and electrically attached through a fuzz-button interface connection as is known in the art.

The Wilkinson divider/combiner layers 104 and 106 are located below the feed circuit layer 22 and provide a guided electromagnetic signal to a corresponding pair of co-linear slots 66*a*–66*d* (FIG. 3) in-phase to produce an electric field linearly polarized and perpendicular to the pair of slots. Similarly, the second Wilkinson divider/combiner layer combines the signals from the orthogonal pair of co-linear slots. The resistive Wilkinson circuits provide termination of odd modes excited on the patch layers and thus eliminate parasitic resonances.

To produce signals having a circular polarization balanced feed configuration (FIG. 3), a stripline quadrature hybrid circuit (replacing the transformer layer 108) combines the signals from each Wilkinson layer in phase quadrature (i.e., 90° phase difference). The balanced slot feed architecture realizes circular polarization, minimizes unbalanced complex voltage excitation between the stripline feeds (unlike conventionally fed two-probe or two-slot architectures), and therefore reduces degradation of the axial ratio figure of merit with scan angles varying from the principal axes of the antenna aperture.

To produce signals having linear polarization, one pair of co-linear slots is removed and one slot replaces the other pair of co-linear slots. A single strip transmission line feeds the single slot thus realizing linear polarization.

Now referring to FIG. 5A, a Smith Chart 120 includes a curve representing the normal impedance locus 124 at via 74 (FIG. 2) on the feed layer and de-embedded impedance locus 132 de-embedded to slot 66 (FIG. 2) of the stacked-patch egg-crate antenna 10.

Figure 5B:
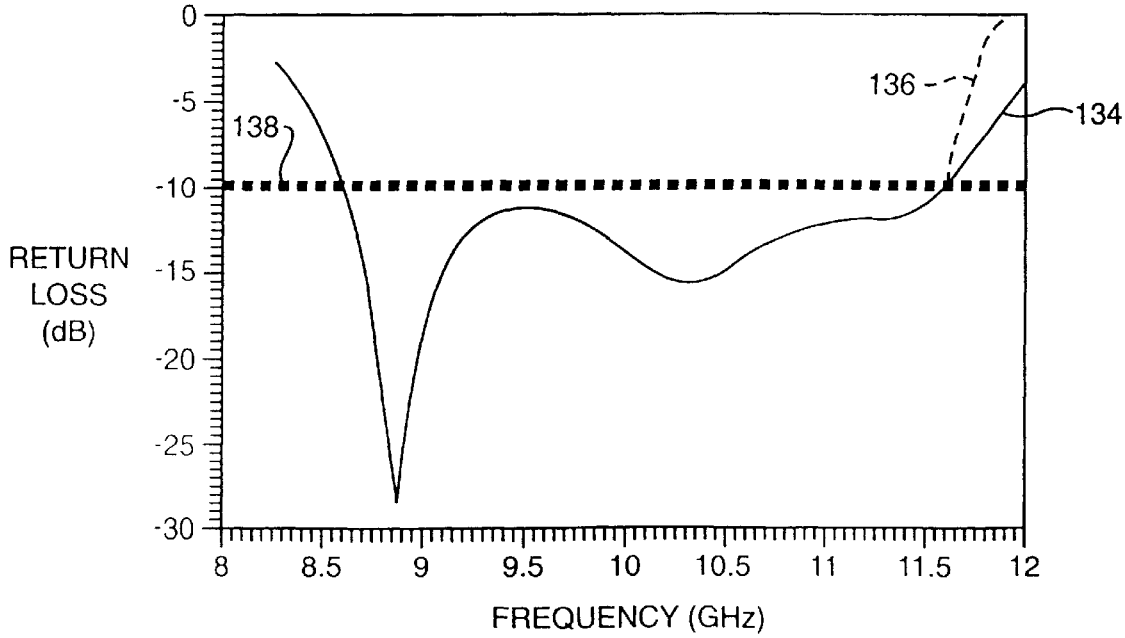
FIG. 5B is a graph of the return loss of the stacked-patch egg-crate antenna in one embodiment according to the invention.

Now referring to FIG. 5B, a return loss curve 134 illustrates the return loss for the entire stacked-patch egg-crate antenna 10 and associated feed system 100. The return loss curve 134 represents the reflected power of the feed circuit layer 22 and slot layer 20 and stacked-patch egg-crate antenna 10 with the via input 74 terminated in a 25 ohm load. A return loss below a −10 dB reference line 138 (i.e., 10 percent reflected power) indicates the maximum acceptable return loss at the via input 74 (FIG. 2). Curve 136 represents the effect of a low pass Frequency Selective Surface (described below in conjunction with FIG. 6).

A heater is optionally incorporated into the upper egg-crate layer 14 (FIG. 1) by running a heater wire (not shown) in the egg-crate layer 14 to prevent ice from building up in the upper patch layer 12 or radome. An embedded anti-icing capability is provided by the upper egg-crate structure 14. A non-conductive, pattern plated egg-crate, formed by conventional injection mold, photolithography and plating processes (e.g., copper or aluminum), includes a conductive cavity (for the radiator function) and a wire pattern (of suitable width and resistivity) plated to the upper face. Alternately, conductive metal wires made of Inconil (a nickel, iron, and chromium alloy) can be embedded between the upper egg-crate surface and upper patch carrier 26 (FIG. 1). Insulated wires and a grounding wire are disposed in conduits in the lower and upper egg-crate ribs supplying power to the wire pattern at one end and a return ground at the other end. The resistive wire pattern generates heat for the upper patch carrier 26 to prevent the formation of ice without obstructing the waveguide cavities or interfering with radiator electromagnetic performance in any manner, for any given lattice geometry and for arbitrary polarization. The widths of the egg-crate ribs (20-mils and 120-mils in the present embodiment) accommodate a wide range of wire conductor widths and number of wires that allow use of a readily available voltage source without the need for transformers.

The upper patch 24 is etched on the internal surface of the upper patch layer 12, which also serves as the radome, and protects the upper (and lower) patch from the environment. The lower and upper egg-crates provide the structural support allowing the upper patch layer to be thin (0.010 in. thick) thus requiring less power for the anti-icing grid, reducing operating and life-cycle costs and minimizing infrared radiation (thereby minimizing detection by heat sensors in a hostile environment). In contrast to a thick, curved radome, the thin flat radome provided by the upper patch layer significantly reduces attenuation of transmitted or received signals (attenuation reduces overall antenna efficiency and increases noise power in the receiver) and distortion of the electromagnetic phase-front (distortion effects beam pointing accuracy and overall antenna pattern shape). Overall, the egg-crate radiator architecture is low profile, lightweight, structurally sound and integrates the functions of heater element and radome in a simple manufacturable package.

Figure 6:
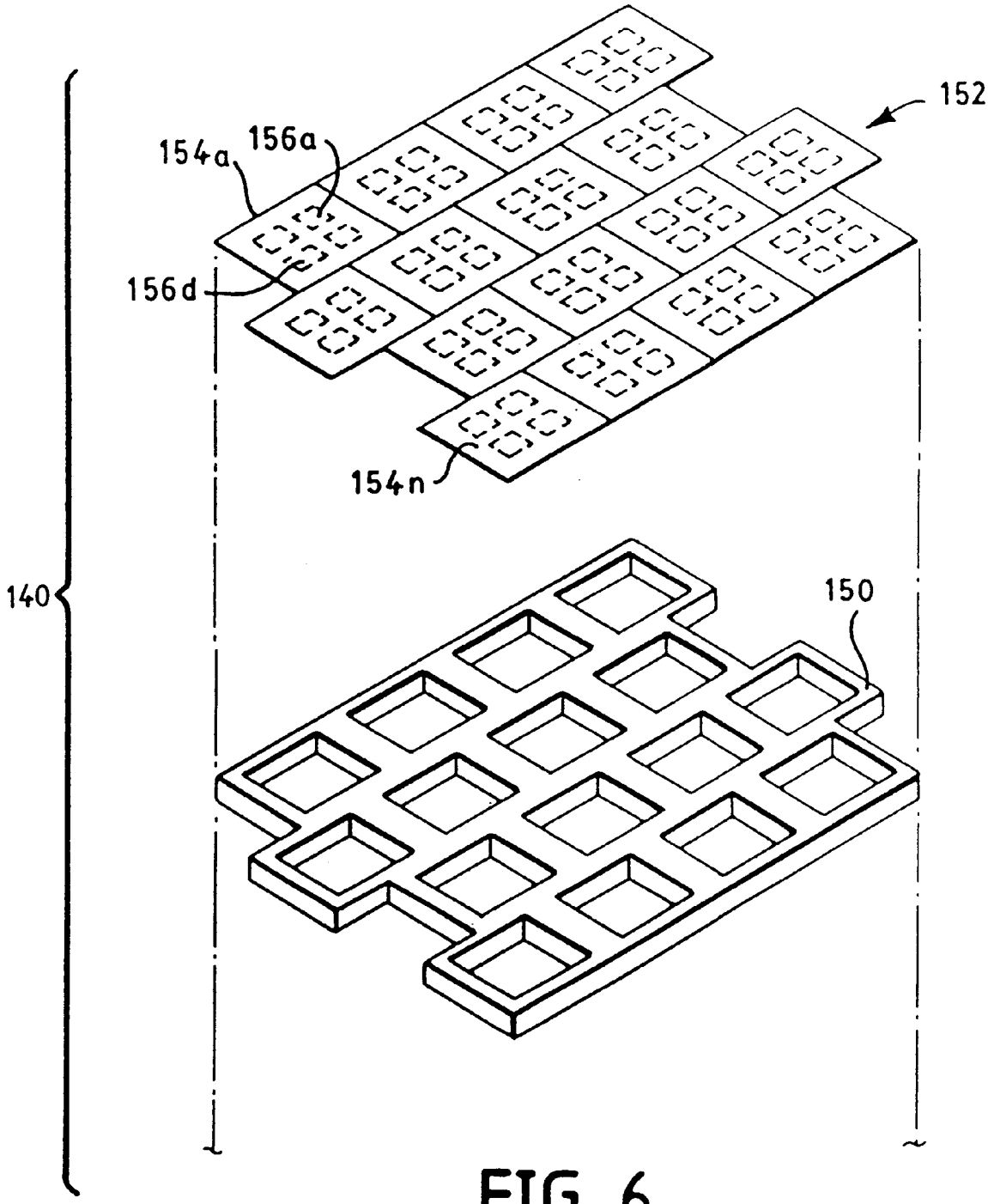
FIG. 6 is a three-dimensional cut away view, of a stacked-patch egg-crate antenna according to an alternate embodiment of the invention.

Now referring to FIG. 6, an alternative embodiment includes a frequency selective surface (FSS) 140 having a third egg-crate layer 150 with a thin, low-pass FSS patch layer 152 disposed on the third egg-crate layer 150 in order to further reduce the radar cross section (RCS).

The FSS patch layer 152 preferably includes a plurality of cells 154*a*–154*n* (generally referred to as cell 154). Each cell 154 includes patches 156*a*–156*d* which in this embodiment act as a low pass filter resulting in a modified return loss signal as indicated by curve 136 (FIG. 5B). It will be appreciated by those of ordinary skill in the art that the size and number of patches 156 can be varied to produce a range of signal filtering effects.

Additionally the upper patch carrier 26 substrate can also accommodate integrated edge treatments (e.g., using PTFE sheets with Omega-ply® layers integrated into the laminate) that reduce edge diffraction. The fabrication techniques and materials used for a modified antenna would be similar. The tapered edge treatments act as RF loads for incident signals at oblique angles exciting surface currents that scatter and diffract at the physical edges of the antenna array. The upper egg-crate can also serve as the heater element and the low-pass frequency selective surface 140 can serve as the radome.

In still another embodiment, optically active materials are integrated in to the upper and lower patch layers 12 and 16. The egg-crate ribs serve as the conduits to run fiber optic feeds (and thus eliminate any interference with the electromagnetic performance of the egg-crate radiators) to layer(s) of optically active material sheets bonded to either or both of the lower and upper egg-crates. The fiber optic signal re-configures the patch dimensions for instantaneous tuning (broad bandwidth capability) and/or presents an entirely "metallic" antenna surface to enhance stealth and reduce clutter. Silicon structures fabricated from a standard manufacturing process (and doped with an appropriate level of metallic ions) have demonstrated "copper-like" performance for moderate optical power intensities. In this embodiment of the egg-crate antenna 10, a thin Silicon slab (doped to produce polygonal patterns when excited), would be placed on top of the lower and/or upper patch dielectric layers. When optically activated, the polygonal patterns become "copper-like" parasitic conductors tuning the copper patches on the lower and/or upper patch dielectric layers and thus instantaneously tuning the egg-crate cavity.

Another advantageous feature of the present invention is frequency scalability of the egg-crate radiator architecture without changing material composition or construction technique while still performing over the same bandwidth and conical scan volume. For example, the following Table 3 summarizes the changes in the egg-crate radiator dimensions scaled to the C-band (5 GHz) for the same material arrangement as shown in FIG. 2.

TABLE 3

| Component | Dimension |
|---|---|
| Upper Patch | 0.26λ × 0.26λ |
| Upper Egg-Crate | 1.00 in. × 1.00 in. (opening) × 0.170λ (height) |
| Lower Patch | 0.40λ × 0.40λ |
| Lower Egg-Crate | 1.00 in. × 1.00 in. (opening) × 0.025λ (height) |

In addition, slot coupling (in contrast to probe coupling) to the egg-crate radiator allows design freedom in choosing the egg-crate material and processes independent of the feed layer materials. For example, the egg-crates could be made from an injection mold and selectively metalized. Furthermore, the upper and lower patch carriers, layers 12 and 16 respectively, can use different dielectric materials. The slot coupled, egg-crate antenna 10 can be used in a tile array architecture or brick array architecture.

All publications and references cited herein are expressly incorporated herein by reference in their entirety.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

What is claimed is:

1. A radiator, responsive to radio frequency (RF) signals in a predetermined frequency range, said radiator comprising:

a waveguide defined by sidewalls having dimensions selected such that the waveguide operates in a cut-off mode within the predetermined frequency range; and a patch antenna disposed in said waveguide, said patch antenna having dimensions such that the combination of said patch antenna and said waveguide operates in a substantially resonant mode within the predetermined frequency range.

2. The radiator of claim 1, wherein said patch antenna is electromagnetically coupled to said waveguide.

3. The radiator of claim 1, further comprising a patch antenna support layer disposed adjacent to said waveguide aperture; and wherein said patch antenna is supported by said support layer.

4. The radiator of claim 3, where the patch antenna support layer is a dielectric.

5. The radiator of claim 1, further comprising a feed circuit electromagnetically coupled to said waveguide, wherein electromagnetic signals pass from said feed circuit into said waveguide and said waveguide is disposed between said feed circuit and said patch antenna.

6. The radiator of claim 5, further comprising a slot layer having at least one slot, disposed between said feed circuit and said patch antenna.

7. The radiator of claim 6, wherein said at least one slot is non-resonant.

8. The radiator of claim 6, wherein said at least one slot has a length less than $\lambda/2$, where $\lambda$ is a free space wavelength radiated by said radiator.

9. The radiator of claim 6, wherein said feed circuit comprises:

a stripline transmission line layer;

a ground plane layer; and wherein said stripline transmission line layer is spaced closer to said at least one slot than to said ground plane layer.

10. The radiator of claim 1, wherein said waveguide is aluminum.

11. The radiator of claim 1, wherein said waveguide is an injection molded material coated with a metal layer.

12. The radiator of claim 1, further comprising a plurality of patch antennas wherein at least one of said patch antennas is resonant at a first frequency and at least another one of the patch antennas is resonant at a different second frequency.

13. The radiator of claim 1, further comprising:

a second waveguide, having an second aperture, disposed adjacent said patch antenna; and a second patch antenna disposed said in the second aperture.

14. The radiator of claim 13, wherein said patch antenna is resonant at a first frequency and said second patch antenna is resonant at a different second frequency.

15. The radiator of claim 1, wherein said patch antenna is copper.

16. The radiator of claim 1, further comprising a plurality of waveguides.

17. A radiator comprising:

a waveguide having an aperture; and a patch antenna disposed in said aperture, wherein said patch antenna is an optically active material.

18. A radiator comprising:

a waveguide having an aperture; and a patch antenna disposed in said aperture, said patch antenna further comprising an integrated edge treatment to reduce edge diffraction.

19. A radiator comprising:

a waveguide having an aperture; and a patch antenna disposed in said aperture wherein said waveguide further comprises a heater disposed on said waveguide.

20. An antenna, adapted for operation in a predetermined frequency range, the antenna comprising:

a plurality of waveguide antenna elements arranged to provide the antenna as an array antenna each of said waveguide antenna elements having a cavity defined by sidewalls having dimensions selected such that each waveguide antenna element in said array of waveguide antenna elements operates in a cut-off mode within the predetermined frequency range; and a plurality of patch antenna elements, each of said plurality of patch antenna elements comprising an upper patch element and a lower patch element and each of said plurality of patch antenna elements disposed in the cavity of a respective one of said plurality of waveguide antenna elements.

21. The antenna of claim 20 wherein said array of waveguide antenna elements comprises a pair of conductive lattices spaced apart and separated by said lower patch layer.

22. An antenna comprising:

a first dielectric layer comprising a first plurality of antenna elements responsive to radio frequency signals having a first frequency;

a first monolithic conductive lattice disposed adjacent to said first dielectric layer;

a second dielectric layer comprising a second plurality of antenna elements responsive to radio frequency signals having a second different frequency, disposed adjacent to said first monolithic conductive lattice;

a second monolithic conductive lattice disposed adjacent to said second dielectric layer; and wherein said first lattice and said second lattice form a plurality of waveguides, each waveguide associated with each of a corresponding said first and corresponding second plurality of antenna elements.

23. The antenna of claim 22, further comprising a feed layer having a plurality of feed circuits, disposed adjacent to said first lattice wherein each of said feed circuits communicates an electromagnetic signal to a corresponding waveguide formed in said first lattice.

24. The antenna of claim 23, further comprising a slot layer having at least one slot disposed between said feed layer and said first lattice; and wherein said at least one slot communicates an electromagnetic signal to a corresponding waveguide formed in said first lattice.

25. The antenna of claim 24, wherein said at least one slot is non-resonant.

26. The antenna of claim 23, wherein each of the plurality of waveguides isolates the electromagnetic signal provided by each corresponding feed circuit from each of the neighboring waveguides.

27. An antenna adapted for operation in a predetermined frequency range, the antenna comprising:

an array of waveguide antenna elements, each element having a cavity; and an array of patch antenna elements comprising an upper patch element and a lower patch element disposed in the cavity wherein said array of waveguide antenna elements comprises a pair of conductive lattices spaced apart and separated by said lower patch layer.

28. A method of fabricating an antenna comprising:

providing a plurality of dielectric layers having an upper surface and a lower surface;

forming a plurality of antenna elements on said lower surface of said plurality of dielectric layers;

providing a plurality of monolithic three dimensional conductive lattices; and bonding each of said plurality of dielectric layers to a corresponding each of said plurality of lattices such that the plurality of patch antenna elements are aligned in a plurality of waveguides formed by said plurality of lattices and the plurality of dielectric layers is interleaved with the plurality of lattices.

29. The method of claim 28, wherein bonding comprises soldering said plurality of dielectric layers to a corresponding each of said plurality of lattices.

30. The method of claim 28, wherein bonding comprises joining said plurality of dielectric layers to a corresponding each of said plurality of lattices with non-lossy bonding adhesives.

31. The method of claim 28, wherein bonding comprises joining said plurality of dielectric layers to a corresponding each of said plurality of lattices with fasteners.

32. The method of claim 28, wherein said dielectric layer has a relative dielectric constant greater than 6 such that a thickness of said dielectric layer is minimized.

33. The method of claim 28, further comprising providing a feed layer and bonding said feed layer to one of said plurality of lattices.

34. The method of claim 28, further comprising scaling the frequency without changing the material composition of the antenna.

35. A radiator, responsive to radio frequency (RF) signals in a predetermined frequency range, said radiator comprising:

a waveguide defined by sidewalls having dimensions selected such that said waveguide is provided having an inductive impedance characteristic within the predetermined frequency range; and a patch antenna disposed in said waveguide, said patch antenna having dimensions selected such that said patch antenna is provided having a capacitive impedance characteristic selected to substantially cancel the inductive impedance characteristic over the predetermined frequency range.

36. The radiator of claim 35 wherein said patch antenna comprises:

a first patch radiator having dimensions such that said first patch radiator is resonant at a first frequency; and a second patch radiator disposed over said first patch radiator, said second patch radiator having dimensions such that said second patch radiator is resonant at second different frequency.

* * * * *

UNITED STATES PATENT AND TRADEMARK OFFICE

CERTIFICATE OF CORRECTION

PATENT NO. : 6,624,787 B2
DATED : September 23, 2003
INVENTOR(S) : Angelo Puzzella It is certified that error appears in the above-identified patent and that said Letters Patent is hereby corrected as shown below:

Column 3,
Line 14, delete "subsystem 110." and replace with -- Subsystem 10. --.

Column 4,
Line 26, delete "embodiment.), light," and replace with -- embodiment) light, --.

Column 5,
Line 15, delete "egg-crates layers 14 and 18" and replace with -- egg-crate layers 14 and 18 --.
Line 39, delete "via's 74" and replace with -- via 74 --.
Lines 45-46, delete "As described above attachment 10" and replace with -- As described above, attachment 10 --.
Lines 47-48, delete "techniques" and replace with -- technique --.
Line 54, delete "egg-crates layers 14 and 18" and replace with -- egg-crate layers 14 and 18 --.

Column 7,
Lines 24-25, delete "include a corresponding" and replace with -- include corresponding --.

Column 8,
Line 19, delete "0.5 (where represents" and replace with -- 0.5 $\lambda$ (where $\lambda$ represents --.

Column 9,
Line 5, delete "coupled the connector" and replace with -- coupled to the connector --.

Signed and Sealed this

Sixth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,624,787 B2
APPLICATION NO. : 09/968685
DATED : September 23, 2003
INVENTOR(S) : Angelo Puzzella It is certified that error appears in the above-identified patent and that said Letters Patent is hereby corrected as shown below:

Column 5, lines 45-46, delete "As described above attachment layer 44d" and replace with --As described above, attachment layer 44d--.

Signed and Sealed this

Second Day of January, 2007

JON W. DUDAS
*Director of the United States Patent and Trademark Office*